US007782260B2

(12) United States Patent
Tsai et al.

(10) Patent No.: US 7,782,260 B2
(45) Date of Patent: Aug. 24, 2010

(54) PLANAR ANTENNA

(75) Inventors: Tiao-Hsing Tsai, Taipei Shien (TW); Chih-Wei Liao, Yilan Shien (TW); Chao-Hsu Wu, Tao Yuan Shien (TW); Chieh-Ping Chiu, Yunlin Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 174 days.

(21) Appl. No.: 12/199,143

(22) Filed: Aug. 27, 2008

(65) Prior Publication Data

US 2009/0256755 A1 Oct. 15, 2009

(30) Foreign Application Priority Data

Apr. 10, 2008 (TW) ..... 97112991 A

(51) Int. Cl.
*H01Q 1/38* (2006.01)

(52) U.S. Cl. ..... 343/700 MS; 343/846

(58) Field of Classification Search ..... 343/700 MS, 343/702, 846

See application file for complete search history.

(56) References Cited

U.S. PATENT DOCUMENTS 6,937,193 B2 * 8/2005 Hendler et al. ..... 343/700 MS
7,289,068 B2 * 10/2007 Fujio et al. ..... 343/700 MS

* cited by examiner

*Primary Examiner*—Hoang V Nguyen
(74) *Attorney, Agent, or Firm*—Stephen A. Bent; Foley & Lardner LLP

(57) ABSTRACT

An antenna includes a dielectric substrate, a grounding plane, first and second grounding elements, and first and second radiating elements. The grounding plane is formed on the dielectric substrate. The first and second grounding elements are formed on the dielectric substrate, have a curved shape and a size that are identical, and are connected to the grounding plane. The first and second radiating elements are formed on the dielectric substrate, have a curved shape and a size that are identical, are operable in the same frequency range, and are connected to the first and second grounding elements, respectively.

15 Claims, 10 Drawing Sheets

PLANAR ANTENNA

CROSS-REFERENCE TO RELATED APPLICATION

This application claims priority of Taiwanese application no. 097112991, filed on Apr. 10, 2008.

BACKGROUND OF THE INVENTION

1. Field of the Invention

This invention relates to an antenna, more particularly to an antenna that is operable in a worldwide interoperability for microwave access (WiMAX) frequency range.

2. Description of the Related Art

A conventional three-dimensional chip antenna, which is applicable to a flash drive and a card reader, is well known in the art.

Although the three-dimensional chip antenna has a small physical size, it is inefficient and is expensive to manufacture.

SUMMARY OF THE INVENTION

Therefore, the object of the present invention is to provide an antenna that can overcome the aforesaid drawbacks of the prior art.

According to the present invention, an antenna comprises a dielectric substrate, a grounding plane, first and second grounding elements, and first and second radiating elements. The grounding plane is formed on the dielectric substrate and has a connecting end. The first and second grounding elements are formed on the dielectric substrate and have a curved shape and a size that are identical. Each of the first and second grounding elements has a first end connected to the connecting end of the grounding plane, and a second end opposite to the first end thereof. The first and second radiating elements are formed on the dielectric substrate, have a curved shape and a size that are identical, are operable in the same frequency range, and are connected to the second ends of the first and second grounding elements, respectively. Each of the first and second radiating elements has a first end, and a second end that is opposite to the first end thereof and that is disposed between the first end of a respective one of the first and second grounding elements and the first end thereof.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
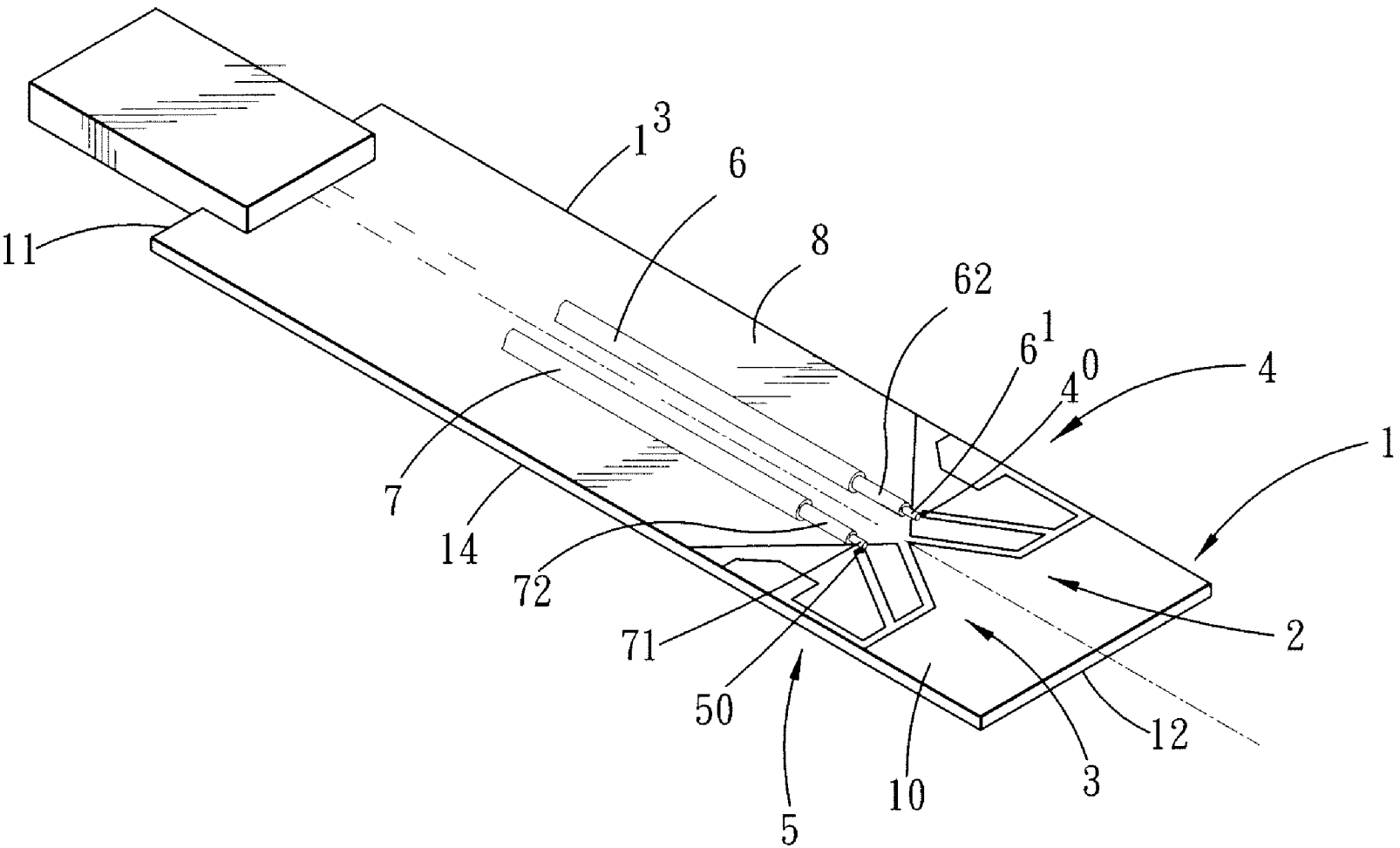
FIG. 1 is a perspective view of the preferred embodiment of an antenna according to this invention.
Figure 2:
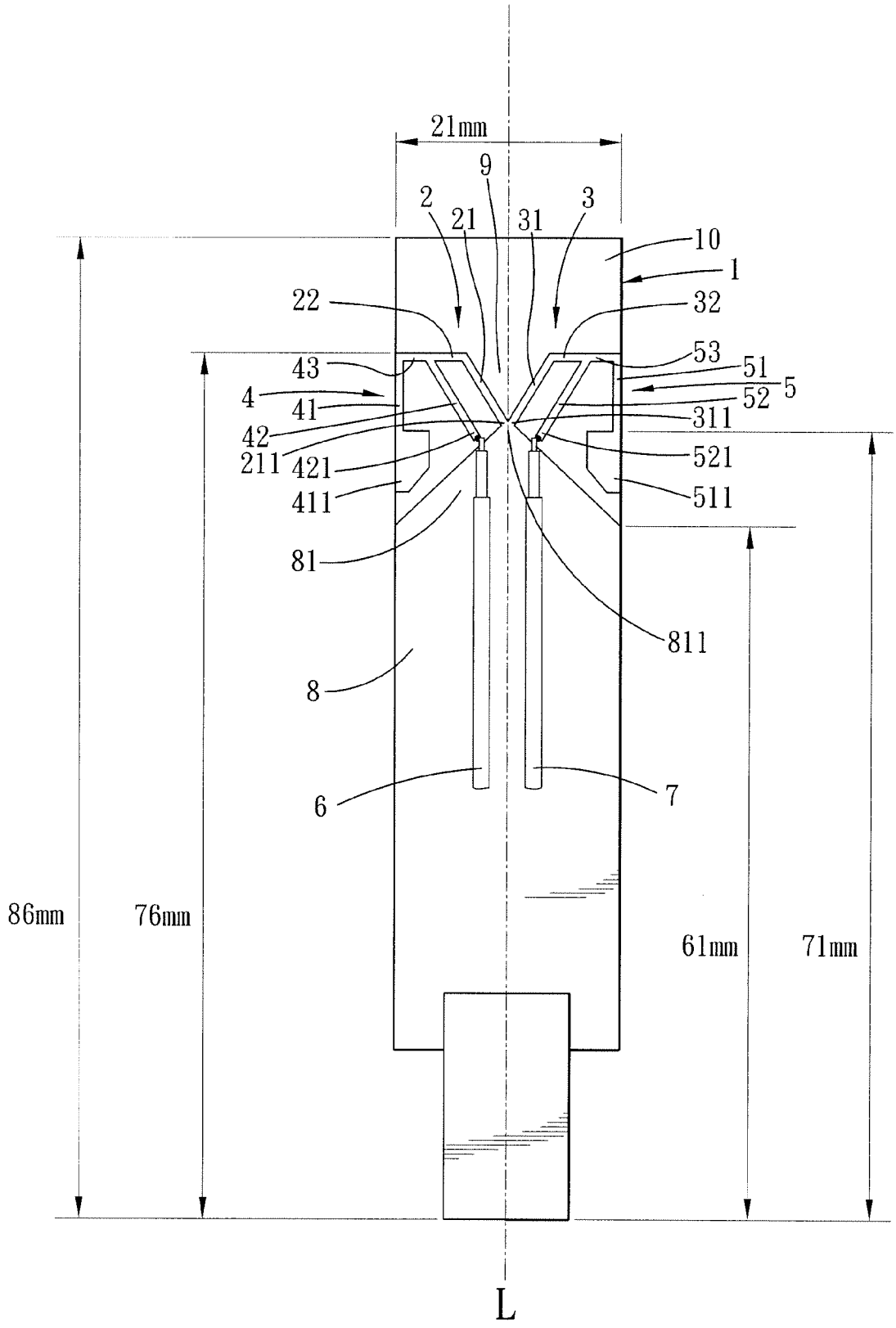
FIG. 2 is a schematic view illustrating a grounding plane, first and second grounding elements, and first and second radiating elements of the preferred embodiment.

Referring to FIGS. 1 and 2, the preferred embodiment of an antenna according to this invention is shown to include a dielectric substrate 1, a grounding plane 8, first and second grounding elements 2, 3, and first and second radiating elements 4, 5.

The antenna of this invention is a planar antenna, is applicable to a flash drive (not shown) and a card reader (not shown), and as best shown in FIG. 2, has a small physical size.

The dielectric substrate 1 is rectangular in shape, has opposite first and second edges 11, 12, and opposite third and fourth edges 13, 14 that interconnect the first and second edges 11, 12. In this embodiment, the dielectric substrate 1 has a thickness of 0.8 millimeters.

The grounding plane 8 is formed on a surface 10 of the dielectric substrate 1, extends from the first edge 11 of the dielectric substrate 1 toward the second edge 12 of the dielectric substrate 1, and has a connecting end 81 that is distal from the first edge 11 of the dielectric substrate 1 and that is tapered.

Each of the first and second grounding elements 2, 3 is formed on the surface 10 of the dielectric substrate 1, and includes first and second segments 21, 31, 22, 32. The first segment 21, 31 of each of the first and second grounding elements 2, 3 has a first end 211, 311 connected to a tip 811 of the connecting end 81 of the grounding plane 8, and a second end opposite to the first end 211, 311 thereof. The second segment 22, 32 of each of the first and second grounding elements 2, 3 has a first end connected to the second end of the first segment 21, 31 of a respective one of the first and second grounding elements 2, 3, and a second end opposite to the first end thereof.

In this embodiment, the first and second grounding elements 2, 3 are symmetrical with respect to an axis of symmetry (L) that passes through the tip 811 of the connecting end 81 of the grounding plane 8. In particular, the first segments 21, 31 of the first and second grounding elements 2, 3 diverge from the tip 811 of the connecting end 81 of the grounding plane 8. As such, a triangular slot 9 is defined between the first segments 21, 31 of the first and second grounding elements 2, 3. Moreover, the second segments 22, 32 of the first and second grounding elements 2, 3 extend away from each other.

Each of the first and second radiating elements 4, 5 is formed on the surface 10 of the dielectric substrate 1, and includes first, second, and third segments 41, 51, 42, 52, 43, 53. The first segment 41, 51 of each of the first and second radiating elements 4, 5 has a first end 411, 511, and a second end opposite to the first end 411, 511 thereof. The second segment 42, 52 of each of the first and second radiating elements 4, 5 has a first end, and a second end 421, 521 opposite to the first end thereof. The third segment 43, 53 of each of the first and second radiating elements 4, 5 interconnects the second end of the first segment 41, 51 of a respective one of the first and second radiating elements 4, 5 and the first end of the second segment 42, 52 of the respective one of the first and second radiating elements 4, 5. In this embodiment, the second end 421 of the second segment 42 of the first radiating element 4 is disposed between the first end 211 of the first segment 21 of the first grounding element 2 and the first end 411 of the first segment 41 of first radiating element 4. Likewise, the second end 521 of the second segment 52 of the second radiating element 5 is disposed between the first end 311 of the first segment 31 of the first grounding element 3 and the first end 511 of the first segment 51 of second radiating element 5. Moreover, in this embodiment, each of the first and second radiating elements 4, 5 is operable in a worldwide interoperability for microwave access I (WiMAX I) frequency range from 2300 MHz to 2700 MHz. Further, in this embodiment, each of the first and second radiating elements 4, 5 has a length of one-quarter wavelength in the WiMAX I frequency range.

The antenna further includes first and second feeding points 40, 50, each of which is provided on the second end 421, 521 of the second segment 42, 52 of a respective one of the first and second radiating elements 4, 5.

In this embodiment, the first and second radiating elements 4, 5 are symmetrical with respect to the axis of symmetry (L). In particular, the second segments 42, 52 of the first and second radiating elements 4, 5 diverge from the first and second feeding points 40, 50, respectively. Moreover, the third segments 43, 53 of the first and second radiating elements 4, 5 extend away from each other. Further, the first segment 41, 51 of each of the first and second radiating elements 4, 5 extends transversely to the third segment 43, 53 of a respective one of the first and second radiating elements 4, 5. In addition, the first segment 41, 51 of each of the first and second radiating elements 4, 5 is formed approximately in the shape of an axe.

The second end of the second segment 22, 32 of each of the first and second grounding elements 2, 3 is connected to a junction of the second segment 42, 52 and the third segment 43, 53 of a respective one of the first and second radiating elements 4, 5.

The antenna further includes a pair of feeding lines 6, 7, each of which has a positive terminal 61, 71 connected to a respective one of the first and second feeding points 40, 50, and each of which has a negative terminal 62, 72 connected to the connecting end 81 of the grounding plane 8. In this embodiment, each of the feeding lines 6, 7 is a coaxial cable. In an alternative embodiment, each of the feeding lines 6, 7 is formed on the surface 10 of the dielectric substrate 1.

During impedance matching for the antenna of this invention, the dimensions of the first or second segment 21, 22 of the first grounding element 2 may be altered to adjust an impedance of the first radiating element 4, and the dimensions of the first or second segment 31, 32 of the second grounding element 3 may be altered to adjust an impedance of the second radiating element 5.

Furthermore, each of the first and radiating elements 4, 5 has an operating frequency that may be adjusted by simply altering the length thereof.

It is noted herein that the first grounding element 2 and the first radiating element 4 constitute a first antenna unit, whereas the second grounding element 3 and the second radiating element 5 constitute a second antenna unit.

Figure 3:
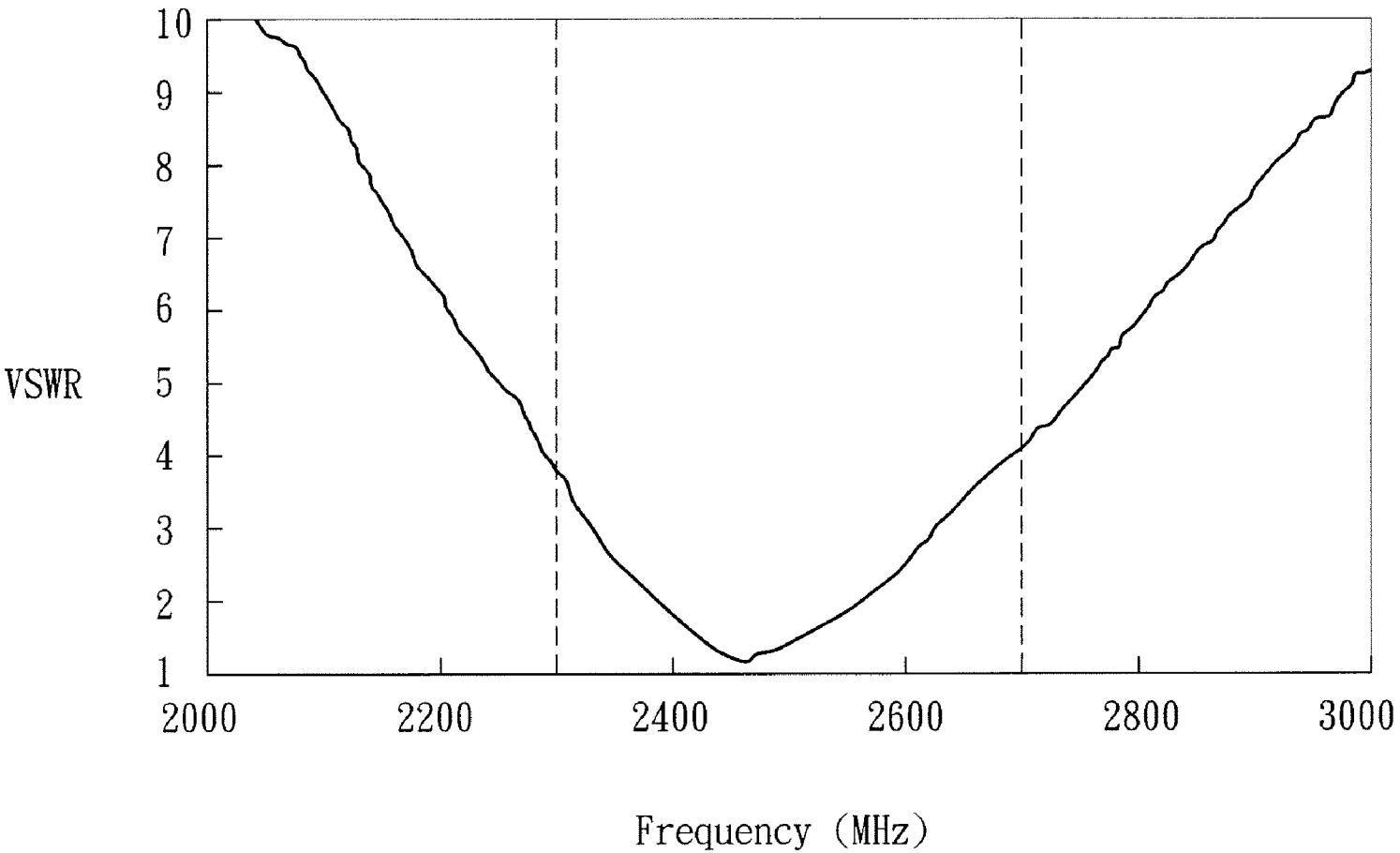
FIG. 3 is a plot illustrating a voltage standing wave ratio (VSWR) of a first antenna unit of the preferred embodiment.
Figure 4:
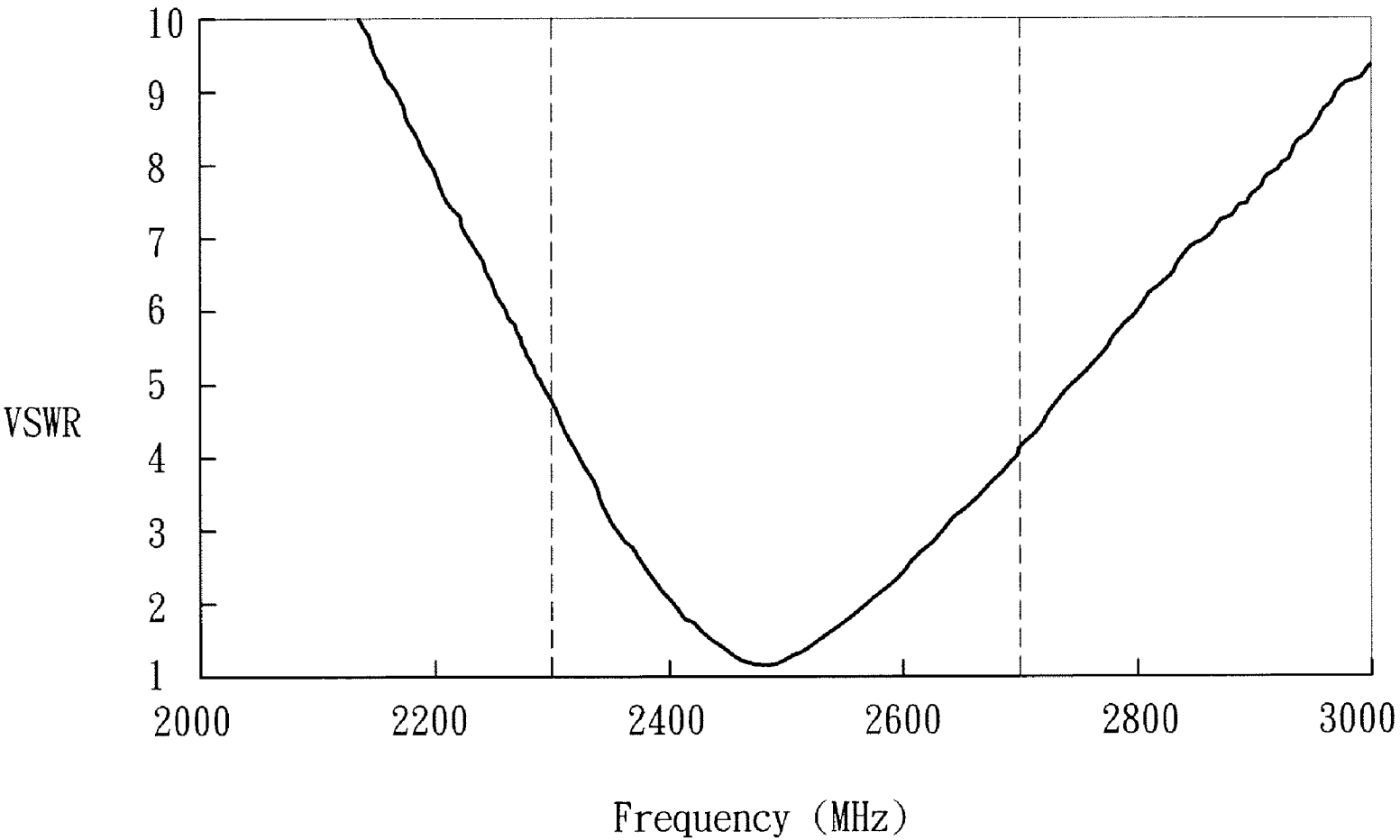
FIG. 4 is a plot illustrating a VSWR of a second antenna unit of the preferred embodiment.

Experimental results show that each of the first antenna unit, as illustrated in FIG. 3, and the second antenna unit, as illustrated in FIG. 4, achieves a satisfactory voltage standing wave ratio (VSWR). Moreover, since the first and second radiating elements 4, 5 operate in the same frequency range, and since the grounding plane 8 and the first and second grounding elements 2, 3 isolate the first and second radiating elements 4, 5 from each other, the antenna of this invention achieves a high isolation and a low envelope correlation coefficient (ECC). Further, when operated in the WiMAX I operating frequency range, the antenna of this invention has a maximum isolation of 17.8 dB, as shown in Table I, and a minimum ECC of 0.04, as shown in Table II. In addition, when operated in the WiMAX I frequency range, as shown in Table III, the first antenna unit has a maximum efficiency of −2.94 dB and a maximum peak gain of 1.45 dBi, while the second antenna unit has a maximum efficiency of −2.92 dB and a maximum peak gain of 1.38 dBi.

Figure 5:
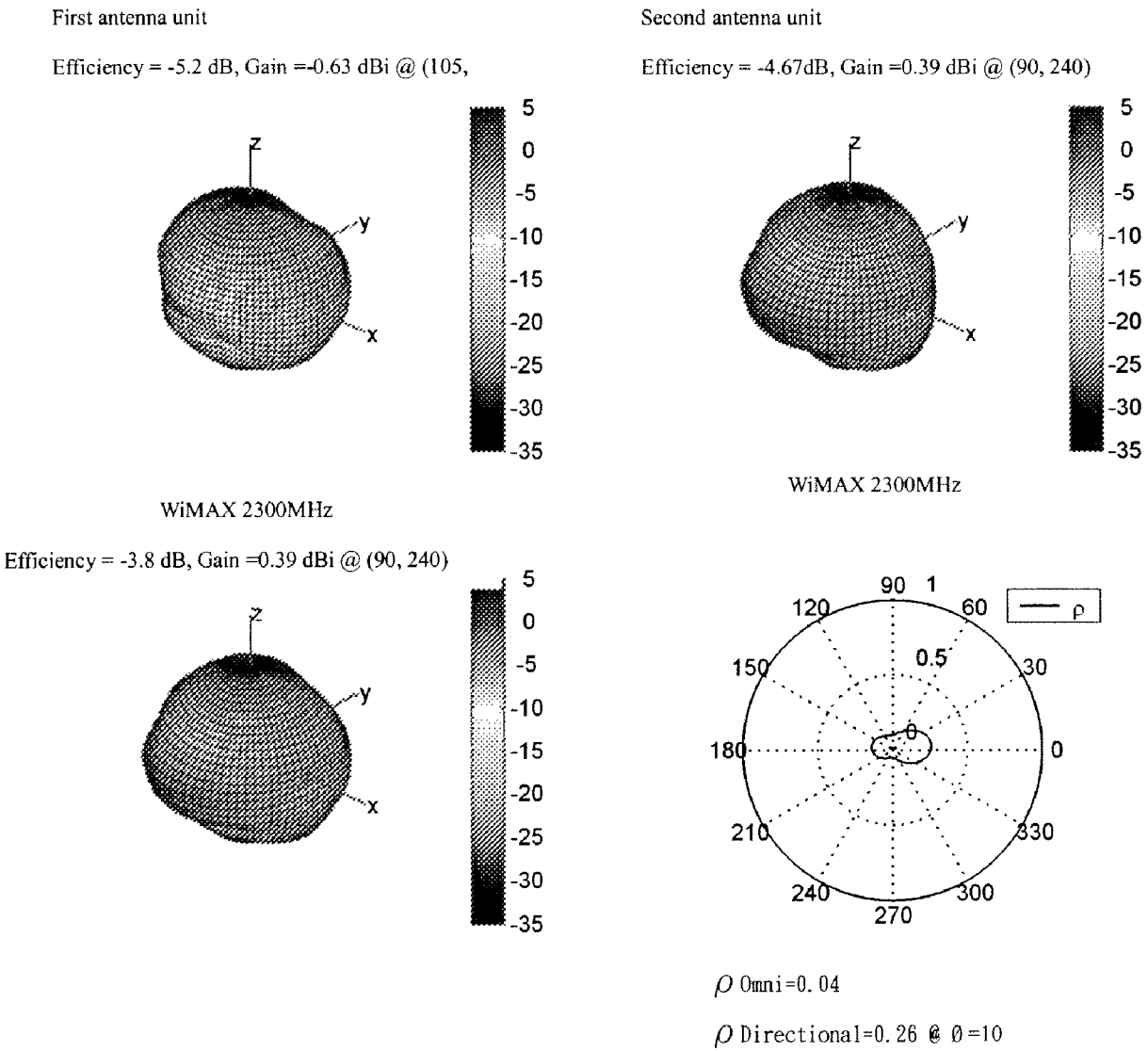
FIG. 5 shows plots of radiation patterns of the first and second antenna units of the preferred embodiment when operated at 2300 MHz.
Figure 6:
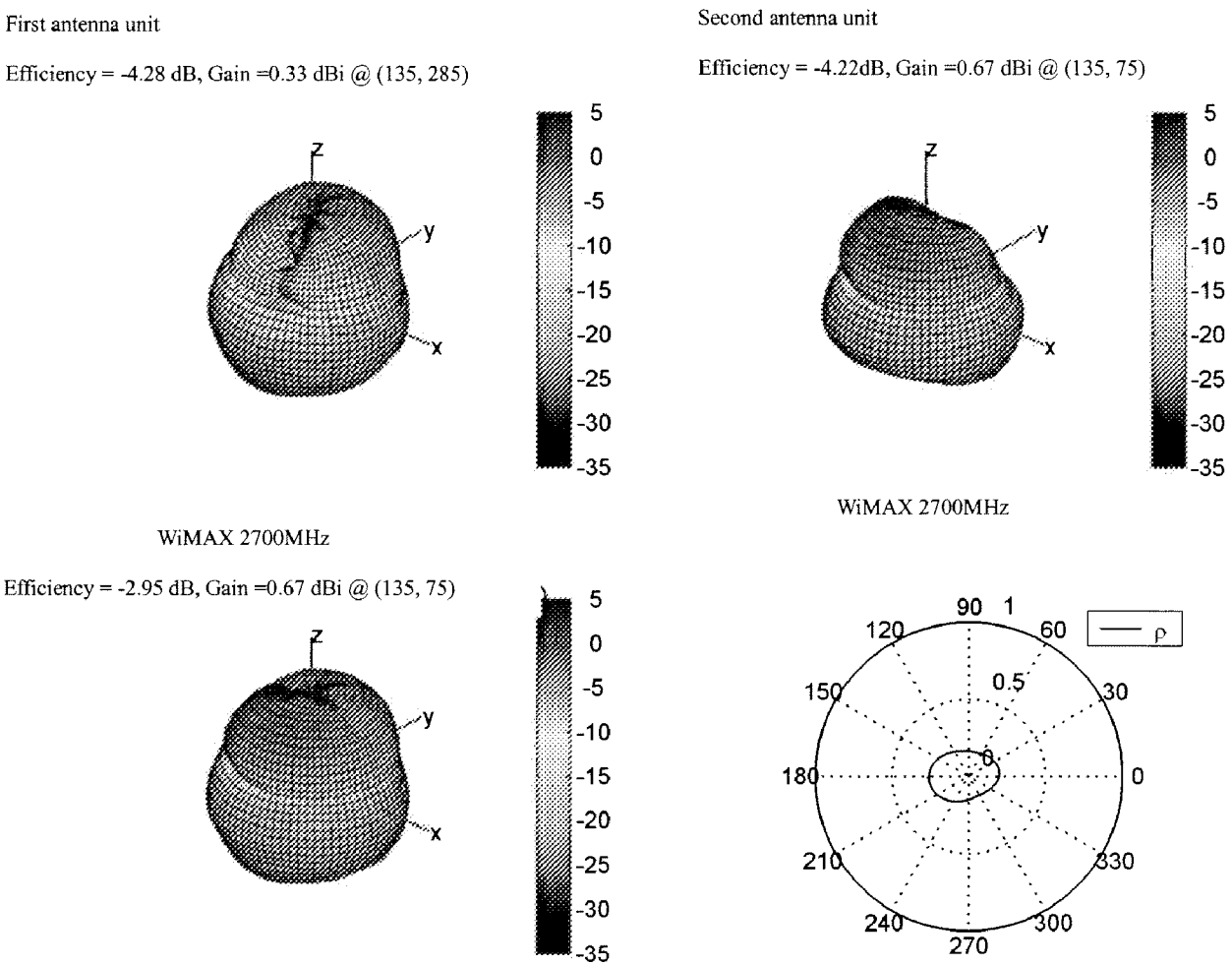
FIG. 6 shows plots of radiation patterns of the first and second antenna units of the preferred embodiment when operated at 2700 MHz.

Furthermore, it is evident from FIGS. 5 and 6 that the relationship between the first and second antenna units is small.

TABLE I

| | Frequency (MHz) | | | | |
|---|---|---|---|---|---|
| | 2300 | 2400 | 2500 | 2600 | 2700 |
| Isolation (dB) | 14.7 | 13.1 | 12.2 | 14.9 | 17.8 |

TABLE II

| | Frequency (MHz) | | | | |
|---|---|---|---|---|---|
| | 2300 | 2400 | 2500 | 2600 | 2700 |
| ECC | 0.04 | 0.16 | 0.11 | 0.05 | 0.22 |

TABLE III

| | first antenna unit | | second antenna unit | |
|---|---|---|---|---|
| Frequency (MHz) | Efficiency (dB) | Peak gain (dBi) | Efficiency (dB) | Peak Gain (dBi) |
| 2300 | −5.25 | −0.71 | −4.69 | 0.44 |
| 2400 | −3.26 | 0.64 | −3.10 | 1.13 |
| 2500 | −2.94 | 1.45 | −3.15 | 0.92 |
| 2600 | −2.96 | 0.28 | −2.92 | 1.38 |
| 2700 | −4.28 | 0.41 | −4.23 | 0.55 |

Figure 7:
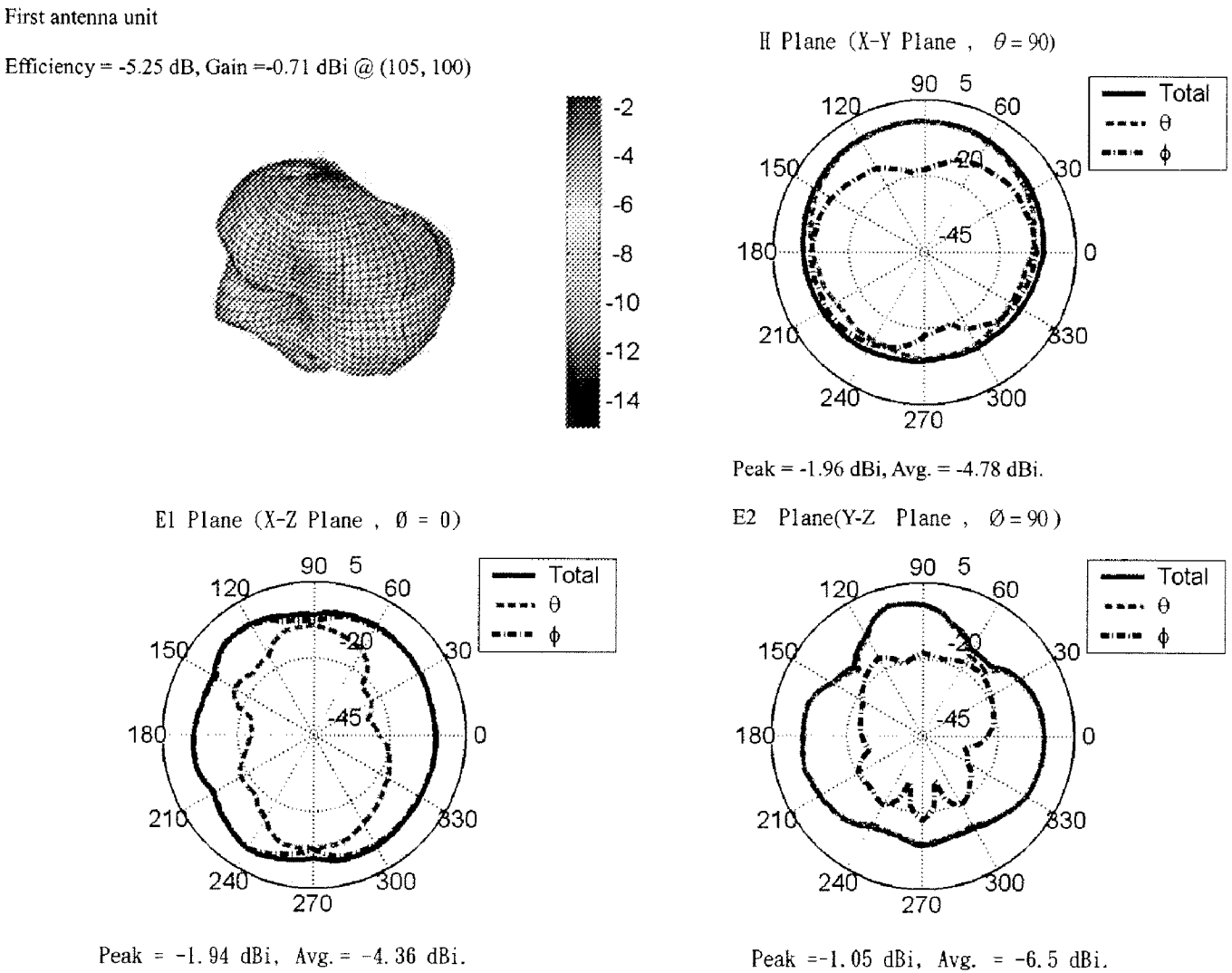
FIG. 7 shows plots of radiation patterns of the first antenna unit of the preferred embodiment respectively on the x-y, x-z, and y-z planes when operated at 2300 MHz.
Figure 8:
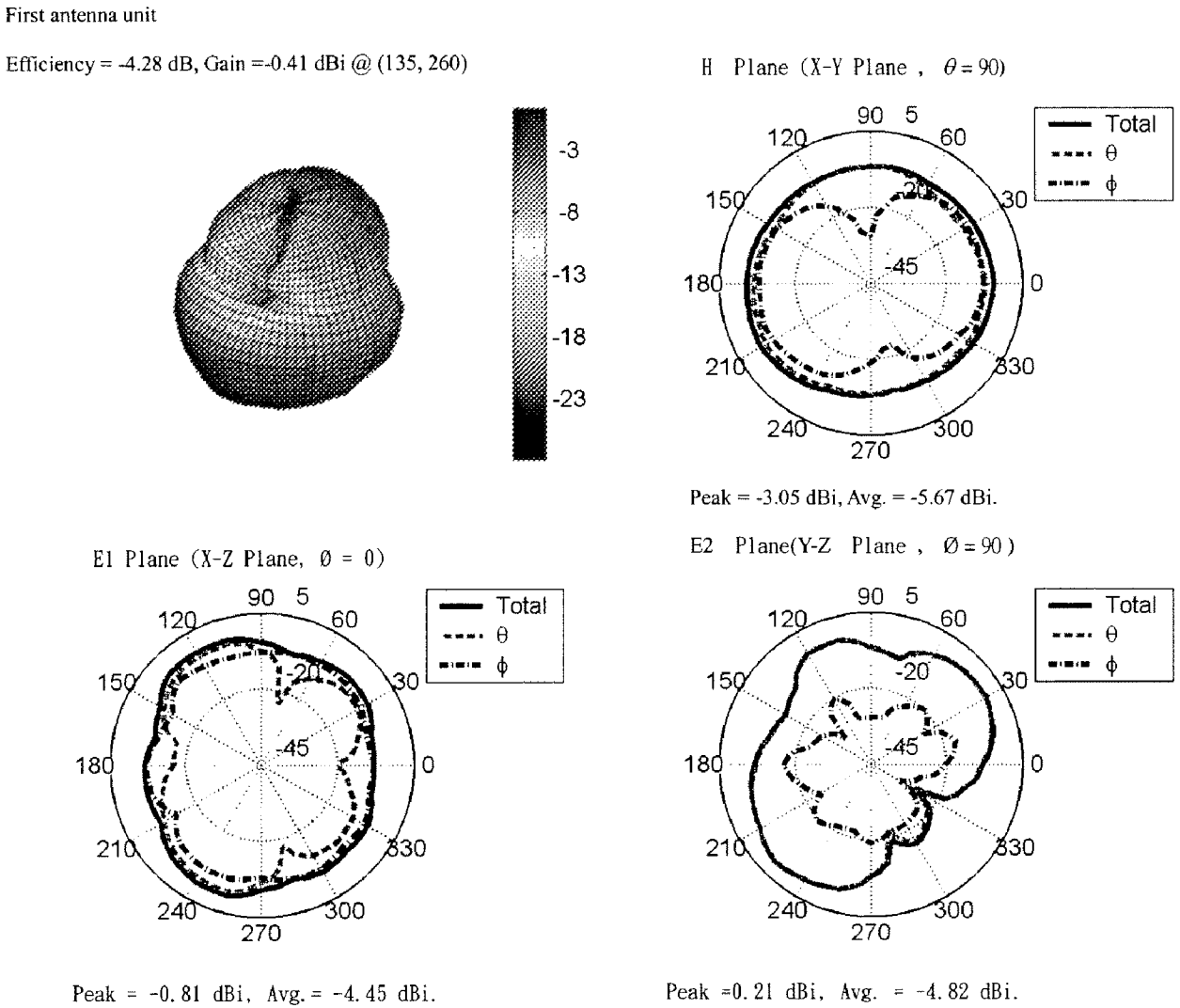
FIG. 8 shows plots of radiation patterns of the first antenna unit of the preferred embodiment respectively on the x-y, x-z, and y-z planes when operated at 2700 MHz.
Figure 9:
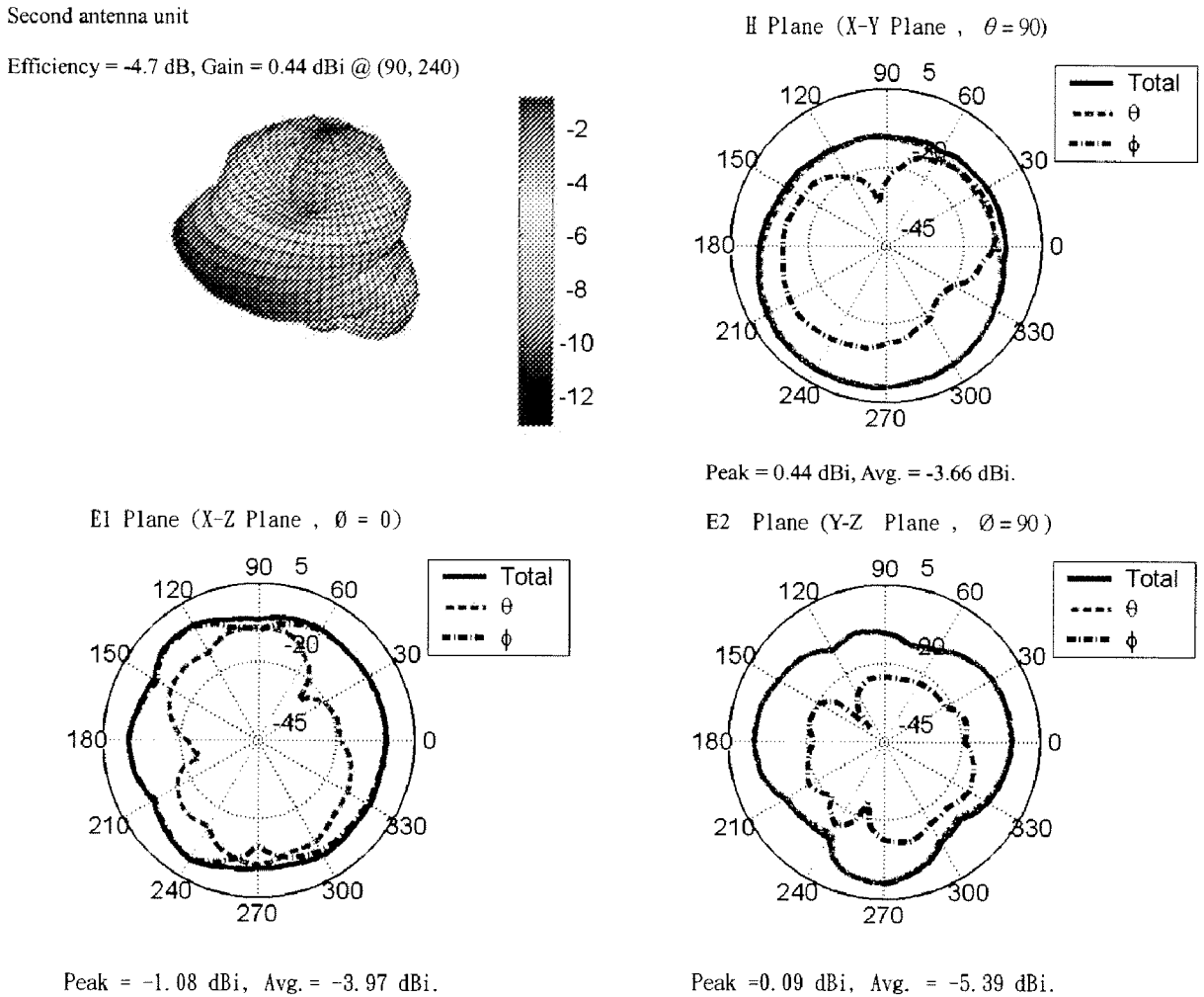
FIG. 9 shows plots of radiation patterns of the second antenna unit of the preferred embodiment respectively on the x-y, x-z, and y-z planes when operated at 2300 MHz.
Figure 10:
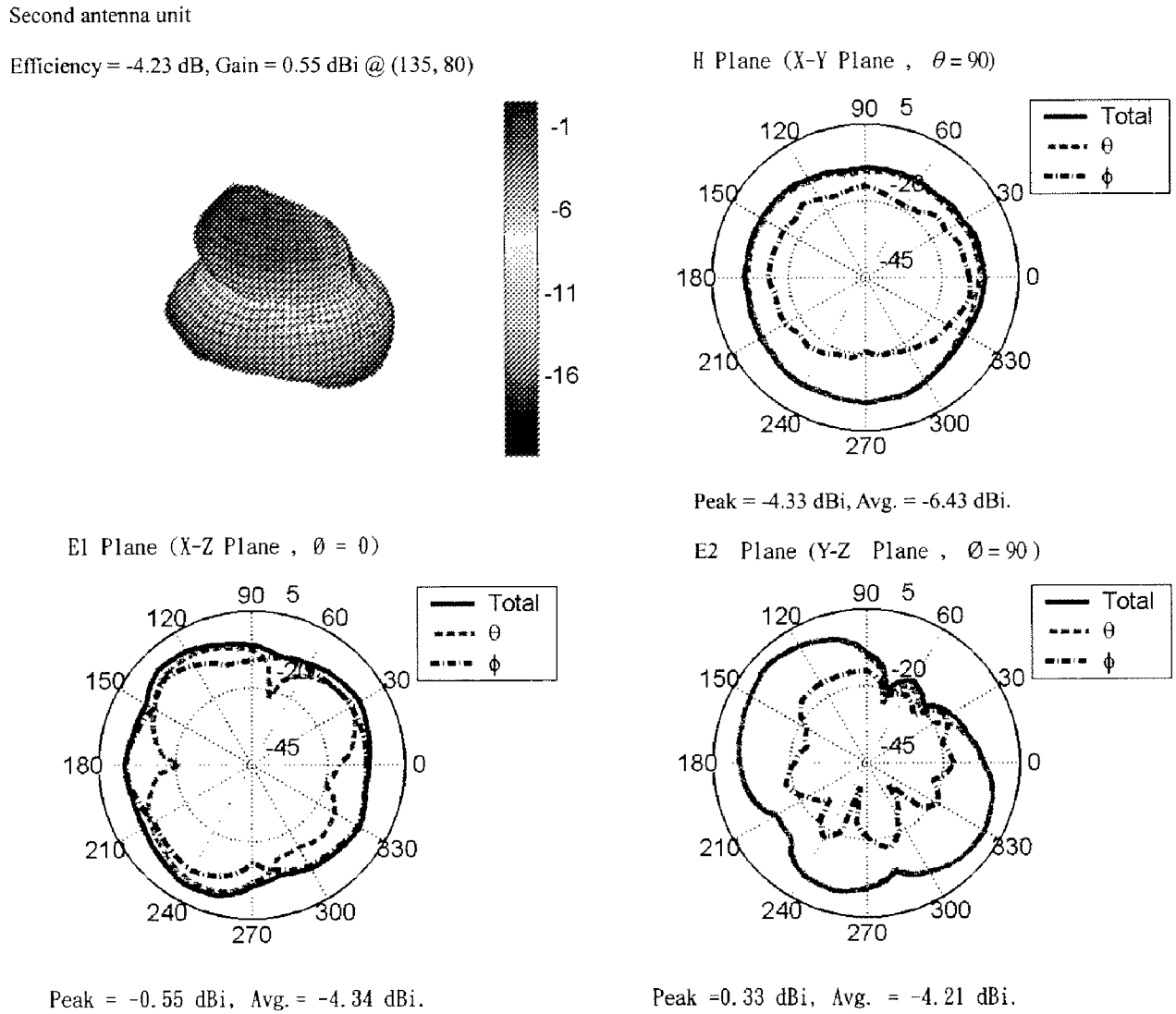
FIG. 10 shows plots of radiation patterns of the second antenna unit of the preferred embodiment respectively on the x-y, x-z, and y-z planes when operated at 2700 MHz.

It is noted that since the radiation patterns of the first antenna unit, as illustrated in FIGS. 7 and 8, complement the radiation patterns of the second antenna unit, as illustrated in FIGS. 9 and 10, it is therefore apparent that the antenna of this invention has a diversity effect that significantly reduces the susceptibility thereof to multipath interference, and thus, an increase in the efficiency thereof is achieved.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna comprising:

a dielectric substrate;

a grounding plane formed on said dielectric substrate and having a connecting end;

first and second grounding elements formed on said dielectric substrate and having a curved shape and a size that are identical, each of said first and second grounding elements having a first end connected to said connecting end of said grounding plane, and a second end opposite to said first end thereof; and first and second radiating elements formed on said dielectric substrate, having a curved shape and a size that are identical, operable in the same frequency range, and connected to said second ends of said first and second grounding elements, respectively, each of said first and second radiating elements having a first end, and a second end that is opposite to said first end thereof and that is disposed between said first end of a respective one of said first and second grounding elements and said first end thereof.

2. The antenna as claimed in claim 1, wherein said connecting end of said grounding plane is tapered and has a tip, and said first end of each of said first and second grounding elements is connected to said tip of said connecting end of said grounding plane.

3. The antenna as claimed in claim 1, wherein said dielectric substrate has a generally rectangular shape, and includes opposite first and second edges, said grounding plane extending from said first edge toward said second edge of said dielectric substrate, said connecting end of said grounding plane being distal from said first edge of said dielectric substrate.

4. The antenna as claimed in claim 1, wherein each of said first and second grounding elements includes first and second segments, said first segment of each of said first and second grounding elements defining said first end of the respective one of said first and second grounding elements, said first end of said first segment of each of said first and second grounding elements being distal from said second segment of the respective one of said first and second grounding elements, said second segment of each of said first and second grounding elements defining said second end of the respective one of said first and second grounding elements, said second end of said second segment of each of said first and second grounding elements being distal from said first segment of the respective one of said first and second grounding elements, said first segments of said first and second grounding elements diverging from said connecting end of said grounding plane, said second segments of said first and second grounding elements extending away from each other.

5. The antenna as claimed in claim 1, further comprising first and second feeding points, each of which is provided on said second end of a respective one of said first and second radiating elements.

6. The antenna as claimed in claim 5, wherein each of said first and second radiating elements includes first and second segments, and a third segment disposed between said first and second segments thereof, said first segment of each of said first and second radiating elements defining said first end of the respective one of said first and second radiating elements, said first end of said first segment of each of said first and second radiating elements being distal from said third segment of the respective one of said first and second radiating elements, said second segment of each of said first and second radiating elements defining said second end of the respective one of said first and second radiating elements, said second end of said second segment of each of said first and second radiating elements being distal from said third segment of the respective one of said first and second radiating elements, said second segments of said first and second radiating elements diverging from said first and second feeding points, respectively, said third segments of said first and second radiating elements extending away from each other, said first segment of each of said first and second radiating elements extending transversely to said third segment of the respective one of said first and second radiating elements, said second end of each of said first and second grounding elements being connected to a junction of said second and third segments of the respective one of said first and second radiating elements.

7. The antenna as claimed in claim 6, wherein said first segment of said first radiating element is formed approximately in the shape of an axe.

8. The antenna as claimed in claim 5, further comprising a feeding line having a positive terminal coupled to said first feeding point, and a negative terminal coupled to said connecting end of said grounding plane.

9. The antenna as claimed in claim 5, further comprising a feeding line having a positive terminal coupled to said second feeding point, and a negative terminal coupled to said connecting end of said grounding plane.

10. The antenna as claimed in claim 1, wherein said first and second grounding elements cooperatively define a slot therebetween.

11. The antenna as claimed in claim 10, wherein said slot has a generally triangular shape.

12. The antenna as claimed in claim 1, wherein said first and second grounding elements are symmetrical.

13. The antenna as claimed in claim 1, wherein said first and second radiating elements are symmetrical.

14. The antenna as claimed in claim 1, wherein the frequency range covers frequencies from 2300 MHz to 2700 MHz.

15. The antenna as claimed in claim 1, wherein said first radiating element has a length of one-quarter wavelength in the frequency range.

* * * * *